US006758431B2

(12) United States Patent
Trutschel

(10) Patent No.: US 6,758,431 B2
(45) Date of Patent: Jul. 6, 2004

(54) DEVICE FOR LINKING TWO WEBS OF MATERIAL

(75) Inventor: Hartwig Horst Trutschel, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/344,893

(22) PCT Filed: Nov. 12, 2001

(86) PCT No.: PCT/DE01/04247

§ 371 (c)(1),
(2), (4) Date: Feb. 26, 2003

(87) PCT Pub. No.: WO02/42190

PCT Pub. Date: May 30, 2002

(65) Prior Publication Data

US 2003/0178523 A1 Sep. 25, 2003

(30) Foreign Application Priority Data

Nov. 24, 2000 (DE) ..... 100 58 458

(51) Int. Cl.[7] ..... B65H 19/18
(52) U.S. Cl. ..... 242/555.3; 242/555.5
(58) Field of Search ..... 242/555, 555.3, 242/555.5, 556

(56) References Cited

U.S. PATENT DOCUMENTS 1,985,221 A * 12/1934 Hezel ..... 242/555.5
2,217,897 A * 10/1940 Freeman ..... 242/555.6
2,596,189 A * 5/1952 Wieking ..... 242/555.5
2,629,562 A * 2/1953 Tollison ..... 242/555.5
3,381,912 A * 5/1968 Huck ..... 242/555.5
4,936,942 A 6/1990 Sollinger et al.
5,152,472 A * 10/1992 Spang et al. ..... 242/556
5,318,656 A * 6/1994 Dylla et al. ..... 242/556
5,356,496 A 10/1994 Lincoln et al.
5,360,181 A * 11/1994 Hayashi et al. ..... 242/555.3
5,423,496 A * 6/1995 Roder ..... 242/555.5
5,740,982 A 4/1998 Kaufmann
5,833,168 A * 11/1998 Tahata et al. ..... 242/555.5
6,241,179 B1 * 6/2001 Hachiya et al. ..... 242/555.3

FOREIGN PATENT DOCUMENTS

| | | |
|---|---|---|
| DE | 19 06 939 | 3/1975 |
| DE | 35 04 536 A1 | 8/1986 |
| DE | 36 06 319 C2 | 4/1990 |
| DE | 42 18 825 A1 | 12/1993 |
| DE | 44 01 963 A1 | 6/1994 |
| EP | 0 720 581 B1 | 4/1998 |
| GB | 1 210 336 | 10/1970 |
| WO | WO 99/40004 | 8/1999 |

* cited by examiner

*Primary Examiner*—William A. Rivera
(74) *Attorney, Agent, or Firm*—Jones, Tullar & Cooper PC

(57) ABSTRACT

Two webs of material, each rolled on a separate roll of material, are linked or spaced together during a web-roll change, without stoppage of the web travel. A linking or splicing device is used for linking, particularly by gluing the fresh web of material to the exhausting web. A cutting device is used to produce two web ends. The cutting device is located downstream of the linking or splicing device, as seen in a direction of travel of the expiring or exhausting web of material.

10 Claims, 4 Drawing Sheets

DEVICE FOR LINKING TWO WEBS OF MATERIAL

FIELD OF THE INVENTION

The present invention is directed to a device for connecting two webs of material during a flying roll change. A connecting device is used to connect the two webs and a cutting device is used to cut the exhausting web from its roll once the webs have been connected.

BACKGROUND OF THE INVENTION

A device for accomplishing a flying roll change is known from DE 42 18 825 A1. A fresh paper web can be glued to the paper web which is running-out in a printing press operating at production speed. After the fresh paper web has been glued on, the paper web which is running-out is cut by use of a cutting device and two web ends are formed in the process. The one web end, together with the fresh paper web, is conveyed through the printing press, and the second web end, together with the used up paper roll, can be removed from the roll changer. In the course of the roll change, both paper rolls rotate in the same direction, and the running-out paper web is moved past the fresh paper roll in such a way that, in the course of gluing it to the running-out paper web, the start of the fresh paper web is brought into contact with the running-out paper web in as tangentially a way as possible.

Another device for accomplishing a flying roll change is known from U.S. Pat No. 4,936,942, wherein a cutting device and a gluing roller are provided in a frame. For a roll change, the frame can approach the running-out paper web from one side, so that when the connecting device is triggered, a gluing roller, together with the running-out paper web, is pressed against a gluing spot of the fresh paper web. Thereafter, the running-out paper web is cut by the cutting knife.

Yet another device for accomplishing a flying roll change is known from EP 0 720 581 B1. The tension of the paper web can be kept substantially constant during the gluing or cutting process by a suitable kinematic movement process.

In connection with the generally known devices for connecting two paper webs in the course of a flying roll change, it is disadvantageous that, because of the arrangement of the connecting device, for example a gluing roller or gluing brush, downstream of the cutting device, in the feed direction of the running-out web of material, a so-called "slip" is necessarily formed. In this case, the length of this slip, i.e. the distance between the connecting point of the fresh and the old web of material and the cut-through web end of the old web of material, is essentially determined by the distance between the connecting device and the cutting device. Interferences are often caused by the slip in the course of conveying the web of material through a processing machine, for example a web-fed rotary printing press. To prevent these interferences, a device is proposed in WO 99/40004 A1, wherein, by use of an appropriate web guidance after the cutting of the old web of material, the slip is pushed outwardly by the centrifugal forces acting on the slip and is subsequently cut off by a cutter bar. It is possible with this to shorten the length of the slip to almost zero. However, a considerable additional structural outlay is required for an appropriate web guidance and for the downstream connected cutter bar.

SUMMARY OF THE INVENTION

The object of the present invention, is directed to providing a device for connecting two webs of material.

In accordance with the present invention, this object is attained by connecting the two webs of material, each wound on a separate roll, during a flying roll change. A connecting device is provided for connecting the fresh web of material with the exhausting web of material. A cutting device is used to cut the exhausting web once the connection has been made. The cutting device and the exhausting web, which is to be cut, are brought into engagement by changing the course of travel of the web to be cut.

The advantages to be obtained by the present invention lie, in particular, in that, because of the arrangement of the cutting device downstream of the connecting device, viewed in the feeding direction of the running-out web of material, the slip can be basically cut off as short as desired when the running-out web of material is cut. When connecting the fresh web of material to the running-out web of material, the result always is a Y-shaped structure, one of whose branches, namely the old web of material starting at the old roll of material up to the gluing point, can essentially be completely cut off by the cutting device which is arranged downstream of the connecting device. By arranging the cutting device downstream of the connecting device, no minimum slip length necessarily results, but the length of the slip can basically be shortened as desired. However, in the course of this, it should be noted that, if the slip length is selected to be too short, there is the potential danger that the fresh web of material is inadvertently damaged by the cutting device.

If the cutting device is arranged downstream of the connecting device, there is the potential danger that the fresh web of material is also inadvertently damaged in the course of cutting through the old web of material. To reliably prevent this danger, it is particularly advantageous if the cutting device is brought into engagement with the web of material to be cut by moving a web guide device, by which the course of the web of material to be cut can be changed. As a result, it is possible to accomplish that the fresh web of material and the web of material to be cut off are guided along different paths in the area downstream of the gluing point, so that only the old web of material is cut. By moving the web guide device, it is, in particular, possible for the fresh web of material and the web of material to be cut to form a defined angle with respect to each other. In this case, the cutting device for cutting the old web of material must be arranged in such a way that, after the gluing point has passed the cutting device, because of its course the old web of material can be cut by contact with the cutting edge of the cutting device. An advantage of this configuration resides, in particular, in that the cutting device for cutting the old web of material need not be moved, but can be arranged fixed in one place.

The change of the course of the old web of material, which is required for cutting the old web of material, can be achieved in a particularly simple manner. The connecting device, for example a gluing roller or gluing brush, after it has pressed the running-out web of material against the fresh web of material, is displaced in such a way that the old web of material comes into engagement with the cutting device.

Alternatively to the displacement of a web guide device, by which the course of the web of material to be cut can be altered, it is also possible that the cutting device will come into engagement with the web of material to be cut by use of a suitable displacement of a web guide device, by which the course of the fresh web of material can be changed, and which will accomplish the simultaneous change of position of the cutting device. In other words, this means that by changing the web guide device, the fresh web of material is rerouted, at least briefly, in such a way that after the position of the cutting device has been changed, the fresh web of material does not come into engagement with the cutting device, and only the old web of material is cut by the change of position of the cutting device.

In order to reliably prevent an unintentional cutting of the fresh web of material by the cutting device, a spacing element can be provided on the cutting device. By use of the spacing element, a defined minimum distance between the cutting device and the fresh web of material is assured.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
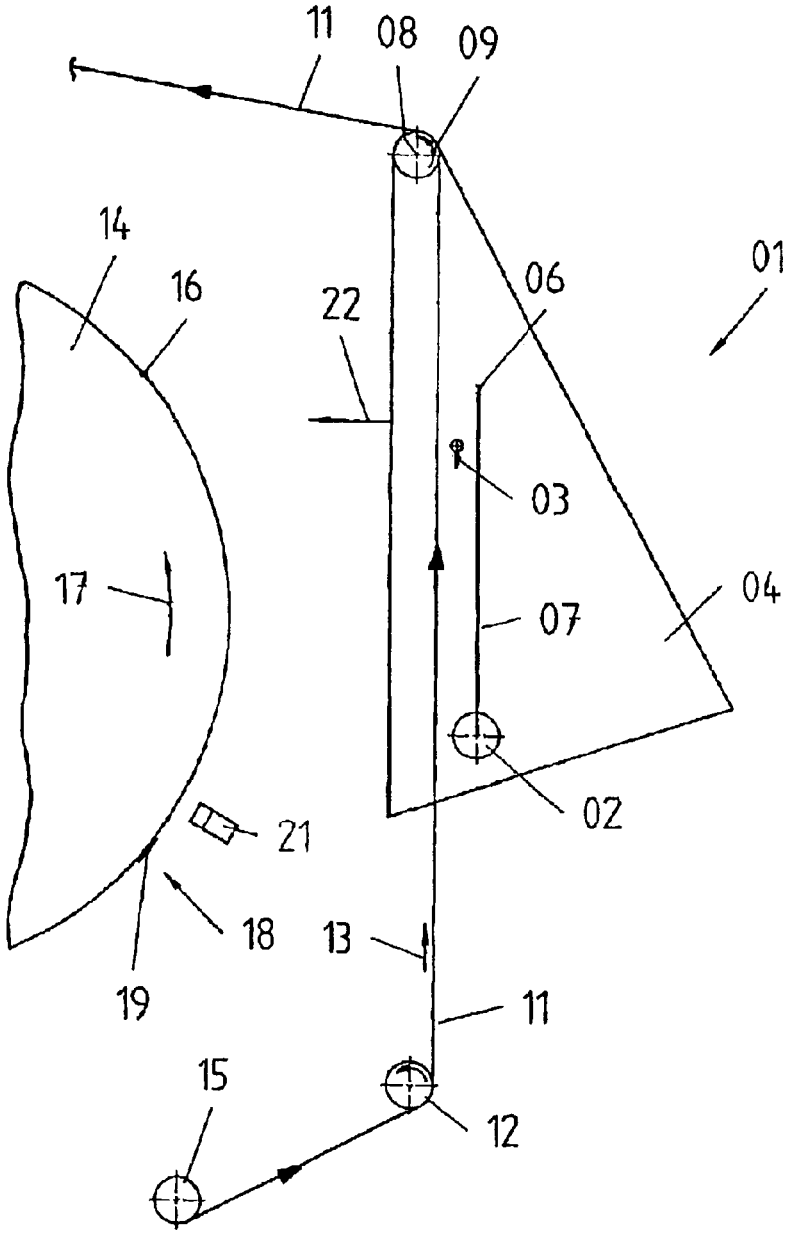
FIG. 1, a schematic side elevation view of a device for connecting two webs of material in accordance with the present invention and in an initial position, FIG. 2, the device of FIG. 1 after the running-out web of material has approached the fresh web of material, FIG. 3, the device of FIG. 1 in the course of pressing the running-out web of material against the fresh web of material, and in FIG. 4, the device of FIG. 1 in the course of cutting the old web of material.

A device 01 for linking two webs of material in accordance with the present invention and with a web connecting device 02, that is embodied in the manner of a gluing roller, in particular a web guide device, and a web cutting device 03, which web cutting device 03 is embodied in the manner of a severing cutter, are represented in FIG. 1. Both the web connecting device 02 and the web cutting device 03 are fastened on a frame 04, with frame 04 being formed by two lateral elements that are arranged parallel with each other. Two pivot arms 07, which are each seated for pivoting around an axis of rotation 06, are provided for use in displacing the web connecting device 02 in relation to the frame 04. The web connecting device 02 can be rotatingly pivoted around the axis of rotation 06 by triggering a drive mechanism, which is not specifically represented. The web connecting device 02 is embodied in the manner of a gluing roller and is rotatably seated at the lower ends of the pivot arms 07. The cutting device 03 is connected with the frame 04 and is fixed in place on it. The frame 04 itself is pivotably seated and can be pivoted around a frame axis of rotation 08, which is the same as, and is aligned with an axis of rotation of a guide roller 09. The frame 04 is pivotable about its axis of rotation 08 by use of a drive device, which is not specifically represented.

FIG. 1 represents the device for linking webs, 01 in its initial position. In the initial position, the device 01 has been pivoted to the right in such a way that neither the cutting device 03 nor the web connecting device 02 come into engagement with one of the webs of material. A running-out or exhausting web of material 11, in particular a paper web, is wound off a depleted roll of material 15, which depleted roll of material 15 is seated in a roll changer, not represented. Web of material 11 is conveyed into a downstream arranged device, for example a rotary printing press, over the web guide rollers 12, 09. The conveying direction of the running-out or exhausting web of material 11 can be determined by the movement arrow 13.

If the old or depleted roll of material 15 is used up to a large extent, and if therefore a flying roll change is to be performed, a fresh or full roll of material 14, on which a fresh web of material 16, in particular a paper web, is wound, is clamped into the roll changer, which is not specifically represented, and is rotationally accelerated in accordance with the movement arrow 17 until the circumferential speed of a web start 18 of the fresh web of material 16 matches the conveying speed of the running-out or exhausting web of material 11. Adhesive labels 19 have been attached to the web start 18 of the fresh web of material 16, so that the fresh web of material 16 can be connected with the running-out or exhausting web of material 11. The passage of the adhesive labels 19 can be detected by utilization of a sensor 21, which is only represented schematically, and can be passed on to the control of the roll changer. As soon as the fresh web of material 14 has reached the required circumferential speed, the frame 04 can be pivoted to the left in accordance with the movement arrow 22 so that the running-out or exhausting web of material 11 initially approaches the fresh roll of material 14.

Figure 2:
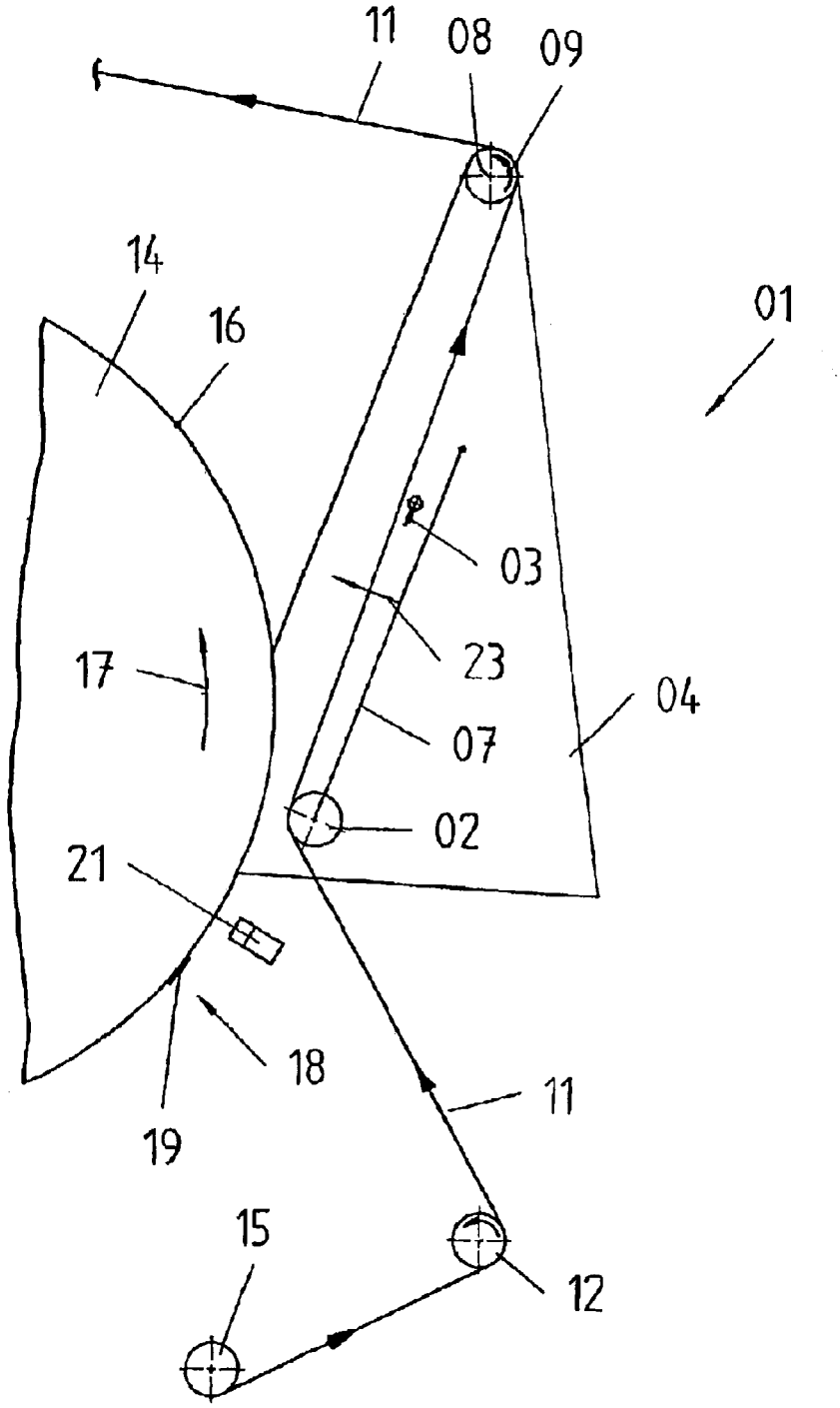

The device for linking webs, 01, is represented in FIG. 2 after the pivoting of the frame 04, for letting the running-out web of material 11 approach the fresh roll of material 14, has been accomplished. In the course of the pivot movement of the frame 04, the web connecting device pivot arms 07 are also pivoted without their moving relative to the frame 04. The result is that the web connecting device 02 now comes into contact with one side of the running-out or exhausting web of material 11 and, with an increasing pivot angle of the frame 04, the web connecting device 02 pushes the running-out or exhausting web of material 11 farther and farther in the direction of the fresh roll of material 14. Since the pivot arms 07 have not yet been displaced, damage to the running-out or exhausting web of material 11 by the cutting device 03, which is fixedly mounted on the frame, is prevented because of the relative arrangement between the web cutting device 03 and the web connecting device 02.

Once the web connecting device 02 has sufficiently approached the fresh roll of material 14 by effecting the pivoting of the frame 04, it is possible to start the actual connection of the running-out web of material 11 with the fresh web of material 16. To this end, a signal is passed on from the sensor 21 to the control device when the adhesive labels 19 pass, so that after receipt of this signal, the control device triggers the drive mechanism for displacing the pivot arms 07. The pivot arms 07, which support the web connecting device 02, are pivoted to the left, in accordance with the movement arrow 23, and, in the process, move the running-out or exhausting web of material 11 along until the running-out or exhausting web of material 11 comes to rest against the fresh roll of material 14 at the exact moment of the passage of the adhesive labels 19. The web start 18 of the fresh web of material 16 is now connected with one side of the old running-out or exhausting web of material 11.

Figure 3:
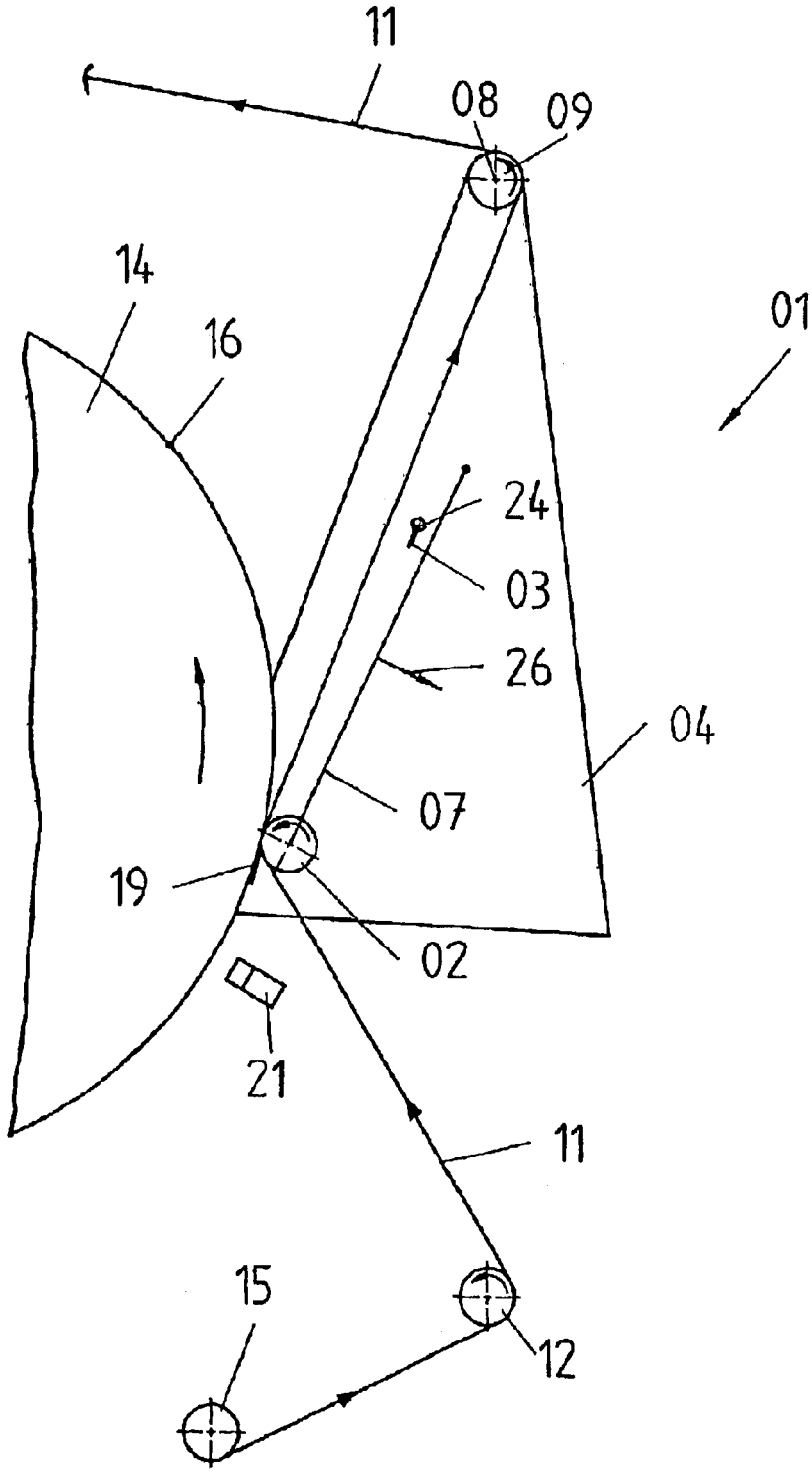

The configuration of the device for linking webs, 01, at the exact moment of the connection between the running-out or exhausting web of material 11 and the fresh web of material 16 is schematically depicted in FIG. 3. It can be seen, by referring to FIG. 4, that, because of the connection of the fresh web of material 16 with one side of the running-out or exhausting web of material 11, a Y-shaped structure results, two of whose branches are formed by the running-out or exhausting web of material 11, and one of whose branches is formed by the fresh web of material 16, and in whose juncture the adhesive labels 19 are located. An unintentional cutting of the running-out web of material 11 at this time is not possible since, because of the arrangement of the cutting device 03 on the frame 04, the cutting device 03 extends essentially parallel with the course of travel of the running-out or exhausting web of material 11 in the area of the frame 04. Furthermore, a circular spacing element 24 is provided on the web cutting device 03, because of which, a defined minimum distance between the running-out or exhausting web of material 11 and the cutting edge of the cutting device 03 is maintained.

To finish the flying roll change, it is necessary to cut the old web of material 11, which up to this time has constituted the running-out or exhausting web of material 11. In order to cut the old web of material 11, without any danger of damage to the fresh web of material 16, the pivot arms 07 are controlled in such a way that they are now pivoted back toward the right in accordance with the movement arrow 26, which arrow 26 is shown in FIG. 3. The course of the old web of material 11 is changed in the area downstream of the gluing point by this pivot movement, so that, as a function of the setting angle of the pivot arms 07, the fresh web of material 16 and the old web of material 11 together form a defined angle a, as seen in FIG. 4, in the area of the gluing point.

Figure 4:
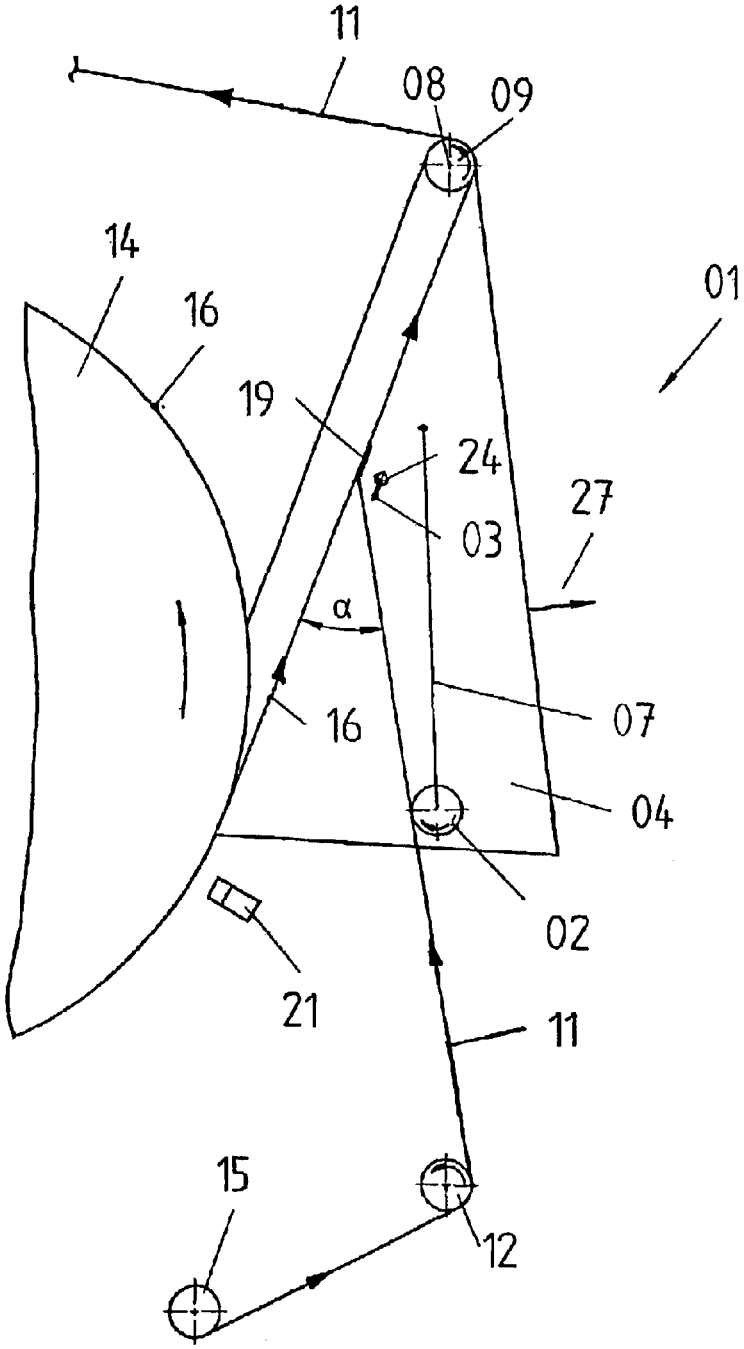

The device for linking webs, 01, is depicted in FIG. 4 at the exact moment of the passage of the adhesive labels 19 past the cutting device 03. At this time, the web connecting device pivot arms 07 have been pivoted back far enough so that the web connecting device 02 just rests against the old web of material 11. The fresh web of material 16 extends under tension between the adhesive labels 19 and the fresh roll of material 14. As soon as the adhesive labels 19 pass the cutting device 03, the old web of material 11 is cut by the cutting device 03 because of the course of travel of this old web. The slip or trail of the now cut old web 11, which is being created in the course of this cutting is only as long as the distance between the cutting edge of the cutting device 03 and the splice point for the fresh web of material 16.

Thereafter, the fresh web of material 16 is conveyed into the downstream located device 01 and the old roll of material 15, together with the cut off web end, is removed from the roll changer. The frame 04 is then pivoted back, in accordance with the movement arrow 27, into its initial position, as represented in FIG. 1.

While a preferred embodiment of a device for linking two webs of material in accordance with the present invention has been set forth fully and completely hereinabove, it will be apparent to one of skill in the art that various changes in, for example, the type of printing press being used, the overall width of the web being cut and the like could be made without departing from the true spirit and scope of the present invention which is to be limited only by the following claims.

What is claimed is:

1. A device for connecting webs of material wound on rolls during a flying roll change comprising:

a web connecting device useable to move an exhausting web of material into contact with a fresh web of material to connect the exhausting web of material, moving in a web direction of travel, with the fresh web of material;

a web cutting device engageable with the exhausting web of material for cutting the exhausting web of material subsequent to said connection; and means for changing a course of travel of the exhausting web of material subsequent to said connection for engaging said web cutting device with the exhausting web of material to be cut.

2. The device of claim 1 wherein said web cutting device is arranged after said web connecting device, in the web a direction of travel of exhausting web of material.

3. The device of claim 2 wherein said web connecting device is a gluing roller.

4. The device of claim 1 wherein said web connecting device is displaceable and further wherein said web cutting device is engageable with the exhausting web of material to be cut by displacement of said web connecting device.

5. The device of claim 4 wherein said displacement of said web connecting device displaces the fresh web of material.

6. The device of claim 1 wherein said web cutting device is parallel with a path of travel of the fresh web of material during the connection of the fresh web of material to the exhausting web of material.

7. The device of claim 1 further including a spacing element for said web cutting device, said spacing element being usable to define a measured minimum distance between a cutting edge of said cutting device, and the fresh web of material.

8. The device of claim 1 further including a displaceable frame supporting at least one of said web connecting device and said web cutting device.

9. The device of claim 8 wherein said frame is displaced forward and away from the fresh roll of material.

10. The device of claim 8 wherein said cutting device is secured on said frame and further wherein said web connecting device is displaced on said frame, the exhausting web of material to be cut being engageable with said web cutting device by displacement of said displaceable web connecting device.

* * * * *